US010950949B2

(12) United States Patent
Jeon et al.

(10) Patent No.: US 10,950,949 B2
(45) Date of Patent: Mar. 16, 2021

(54) ELECTRONIC DEVICE INCLUDING PRINTED CIRCUIT BOARD

(71) Applicant: Samsung Electronics Co., Ltd., Suwon-si (KR)

(72) Inventors: Seung Gil Jeon, Suwon-si (KR); Hyung Wook Kim, Suwon-si (KR); Jeong Heum Lee, Suwon-si (KR); Jong Hwan Lee, Suwon-si (KR); Ho Young Im, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 63 days.

(21) Appl. No.: 16/130,495

(22) Filed: Sep. 13, 2018

(65) Prior Publication Data

US 2019/0081404 A1 Mar. 14, 2019

(30) Foreign Application Priority Data

Sep. 14, 2017 (KR) ..... 10-2017-0117584

(51) Int. Cl.
*H01Q 13/10* (2006.01)
*H01Q 9/04* (2006.01)
(Continued)

(52) U.S. Cl.
CPC ..... *H01Q 13/103* (2013.01); *H01Q 1/084* (2013.01); *H01Q 1/2283* (2013.01);
(Continued)

(58) Field of Classification Search
CPC .... H01Q 13/103; H01Q 21/065; H01Q 21/08; H01Q 1/2283; H01Q 1/523; H01Q 9/0414; H01Q 1/084; H01Q 1/2291; H01Q 1/38; H01Q 9/0457; H01Q 9/0435; H01Q 13/106; H01Q 1/2258; H01Q 1/242; H01Q 1/36
See application file for complete search history.

(56) References Cited

U.S. PATENT DOCUMENTS 3,895,435 A 7/1975 Turner et al.
4,924,236 A 5/1990 Schuss et al.
(Continued)

FOREIGN PATENT DOCUMENTS

CN 1154579 A 7/1997
CN 102570013 A 7/2012
(Continued)

OTHER PUBLICATIONS

European Search Report dated Feb. 13, 2019, issued in European Application No. 18194125.3-1205.
(Continued)

*Primary Examiner* — Dameon E Levi
*Assistant Examiner* — David E Lotter
(74) *Attorney, Agent, or Firm* — Jefferson IP Law, LLP

(57) ABSTRACT

An electronic device is provided. The electronic device includes a housing that includes a first surface, a second surface facing the first surface, and a side surface surrounding a space between the first and second surfaces, a printed circuit board (PCB) that is arranged inside the housing and includes at least one antenna unit, and a communication circuit that is arranged inside the PCB or between the PCB and the housing.

15 Claims, 16 Drawing Sheets

(51) Int. Cl.

| | |
|---|---|
| ***H01Q 21/06*** | (2006.01) |
| ***H01Q 21/08*** | (2006.01) |
| ***H01Q 1/22*** | (2006.01) |
| ***H01Q 1/52*** | (2006.01) |
| ***H01Q 1/08*** | (2006.01) |
| ***H01Q 1/38*** | (2006.01) |

(52) U.S. Cl.

CPC ..... *H01Q 1/2291* (2013.01); *H01Q 1/38* (2013.01); *H01Q 1/523* (2013.01); *H01Q 9/0414* (2013.01); *H01Q 9/0435* (2013.01); *H01Q 9/0457* (2013.01); *H01Q 13/106* (2013.01); *H01Q 21/065* (2013.01); *H01Q 21/08* (2013.01)

(56) References Cited

U.S. PATENT DOCUMENTS

| | | | | |
|---|---|---|---|---|
| 5,798,734 | A | 8/1998 | Ohtsuka et al. | |
| 7,102,571 | B2 | 9/2006 | McCarrick | |
| 7,785,138 | B2 | 8/2010 | Bonnassieux et al. | |
| 8,749,446 | B2 | 6/2014 | Manry, Jr. et al. | |
| 9,130,278 | B2 | 9/2015 | Palevsky et al. | |
| 9,178,260 | B2 | 11/2015 | Biglarbegian et al. | |
| 9,196,965 | B2 | 11/2015 | Sabielny | |
| 9,252,499 | B2 | 2/2016 | Chen et al. | |
| 9,257,735 | B2 | 2/2016 | Fakharzadeh et al. | |
| 9,265,151 | B2 | 2/2016 | Junemann et al. | |
| 9,391,370 | B2 | 7/2016 | Tzanidis et al. | |
| 9,520,635 | B2 | 12/2016 | Fakharzadeh et al. | |
| 9,755,306 | B1 | 9/2017 | Ogilvie | |
| 9,773,742 | B2 | 9/2017 | Kamgaing et al. | |
| 9,865,935 | B2 | 1/2018 | Miraftab et al. | |
| 10,074,900 | B2 | 9/2018 | Navarro et al. | |
| 10,658,312 | B2 | 5/2020 | Kamgaing et al. | |
| 2004/0090369 | A1 | 5/2004 | McCarrick | |
| 2004/0217830 | A1 | 11/2004 | Hansen et al. | |
| 2005/0152306 | A1* | 7/2005 | Bonnassieux ..... | H04W 84/22 370/328 |
| 2011/0056067 | A1 | 3/2011 | Bonnassieux et al. | |
| 2012/0002655 | A1 | 1/2012 | Bonnassieux et al. | |
| 2012/0162015 | A1* | 6/2012 | Chen ..... | H01Q 9/0457 343/700 MS |
| 2012/0256796 | A1* | 10/2012 | Leiba ..... | H01Q 1/2283 343/702 |
| 2013/0002491 | A1 | 1/2013 | Sabielny | |
| 2013/0127682 | A1 | 5/2013 | MacManus et al. | |
| 2014/0145891 | A1 | 5/2014 | Palevsky et al. | |
| 2014/0285383 | A1 | 9/2014 | Fakharzadeh et al. | |
| 2014/0285389 | A1 | 9/2014 | Fakharzadeh et al. | |
| 2014/0285393 | A1 | 9/2014 | Biglarbegian et al. | |
| 2015/0381229 | A1* | 12/2015 | Tzanidis ..... | H01Q 1/50 455/73 |
| 2016/0204514 | A1 | 7/2016 | Miraftab et al. | |

FOREIGN PATENT DOCUMENTS

| | | | |
|---|---|---|---|
| CN | 102904019 | A | 1/2013 |
| CN | 103392261 | A | 11/2013 |
| CN | 104867912 | A | 8/2015 |
| CN | 107046170 | A | 8/2017 |
| JP | 2-252304 | A | 10/1990 |
| JP | H05-160626 | A | 6/1993 |
| JP | H05-166018 | A | 7/1993 |

OTHER PUBLICATIONS

International Search Report dated Dec. 4, 2018, issued in International Application No. PCT/KR2018/009730.

Beer S et al:"Microstrip slot antenna array in LTCC technology for a 122 GHz system-in-package", Antennas and Propagation Society International Symposium (APSURSI), 2012 IEEE, IEEE, Jul. 8, 2012 (Jul. 8, 2012), pp. 1-2, XP032471577.

Chinese Office Action dated Dec. 25, 2020, issued in Chinese Patent Application No. 201811025355.0.

European Office Action dated Nov. 12, 2020, issued in European Patent Application No. 18 194 125.3.

* cited by examiner

ELECTRONIC DEVICE INCLUDING PRINTED CIRCUIT BOARD

CROSS-REFERENCE TO RELATED APPLICATION(S)

This application is based on and claims priority under 35 U.S.C. § 119(a) of a Korean patent application number 10-2017-0117584, filed on Sep. 14, 2017, in the Korean Intellectual Property Office, the disclosure of which is incorporated by reference herein its entirety.

BACKGROUND

1. Field

The disclosure relates to a technology related to a printed circuit board (PCB) on which an antenna is mounted.

2. Description of Related Art

Recently, as the number of smart phone users has increased, an amount of using wireless Internet has also been rapidly increased. In addition to the above-mentioned smart phones, amounts of using tablet personal computers (PCs) and laptops have also been increased, and thus, the use of wireless Internet has been increased in homes as well as offices.

In order to use such wireless Internet by many people, the spread of electronic devices such as a router has increased in offices and homes. For example, the electronic device may be connected to a signal line that is brought into an office or home. The electronic device connected to the signal line may be wirelessly coupled to other electronic devices (e.g., smart phones, tablet PCs, notebooks, and the like). The electronic device may set an Internet protocol (IP) address through the signal line, and transmit/receive various data to/from other electronic devices.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a method of forming a director and a spacer on a printed circuit board (PCB) and an electronic device including the PCB.

To increase the signal transmission/reception rate of an electronic device, an electronic device may be equipped with a director and a spacer. The director may induce the signal radiated from an antenna in a specific direction to increase the signal transmission/reception rate of the electronic device. The spacer may increase the signal transmission/reception rate by providing a space into which a dielectric material is introduced between the director and the antenna.

However, when the director and spacer are mounted in an electronic device, respectively, mismatches may occur between the director and the antenna and between the spacer and the antenna. Such a mismatch may reduce the signal transmission/reception rate of the electronic device. In addition, when the director and spacer are mounted in an electronic device, respectively, the production cost may increase and the process may be complicated.

Additional aspects will be set forth in part in the description which follows and, in part, will be apparent from the description, or may be learned by practice of the presented embodiments.

In accordance with an aspect of the disclosure, an electronic device is provided. The electronic device includes a housing that includes a first surface, a second surface facing the first surface, and a side surface surrounding a space between the first and second surfaces, a PCB that is arranged inside the housing and includes at least one antenna unit, and a communication circuit that is arranged inside at least one of the PCB or between the PCB and the housing, wherein the PCB includes a first substrate, a second substrate facing the first substrate, and a spacer arranged between the first and second substrates and formed on a specified region with an opening, wherein each of the at least one antenna unit includes a director formed on the first substrate, a patch-type radiator formed on the second substrate and facing the director through the opening, and a feeder connecting the patch-type radiator to the communication circuit, and wherein the communication circuit feeds power to the feeder and at least one of transmitsor receives a signal of a specified frequency band through an electrical path formed through the feeder and the patch-type radiator.

In accordance with another aspect of the disclosure, a PCB id provided. The PCB includes a first layer, a second layer facing the first layer, a side member arranged between the first and second layers and formed in a specified region with an opening, a first conductive member formed on the first layer, a second conductive member formed on the second layer and facing the first conductive member through the opening, and a feeder connecting the second conductive member to an external component.

In accordance with another aspect of the disclosure, an electronic device is provided. The electronic device includes a housing that includes a first surface, a second surface facing the first surface, and a side surface surrounding a space between the first and second surfaces, and a PCB that is arranged inside the housing or is attached to the first surface, wherein the PCB includes at least one antenna unit and a wireless communication circuit electrically connected to each of the at least one antenna unit, wherein each of the at least one antenna unit includes a director arranged in a first region, a patch-type radiator arranged in a second region facing the first region, and a feeder electrically connecting the patch-type radiator to the wireless communication circuit, and wherein the wireless communication circuit feeds power to the feeder and at least one of transmits or receives a signal of a specified frequency band through an electrical path formed through the feeder and the patch-type radiator.

In accordance with another aspect of the disclosure, an electronic device is provided. The electronic device includes a housing, an antenna structure that includes a first substrate including a plurality of conductive regions, a second substrate formed of an insulating material, and a first plurality of insulating layers and a second plurality of conductive layers that are alternately stacked between the first and second substrates, wherein the first plurality of insulating layers and the second plurality of conductive layers form a plurality of inner spaces between the first and second substrates such that the conductive regions are exposed to the inner spaces and located in the inner spaces when viewed from above the first substrate, and a wireless communication circuit electrically connected to the conductive regions.

According to various embodiments of the disclosure, the performance of an antenna may be improved.

According to various embodiments of the disclosure, the process of manufacturing a PCB and an antenna may be simplified.

According to various embodiments of the disclosure, the manufacturing cost of a PCB and an antenna may be reduced.

In addition, various effects that are directly or indirectly understood through the disclosure may be provided.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
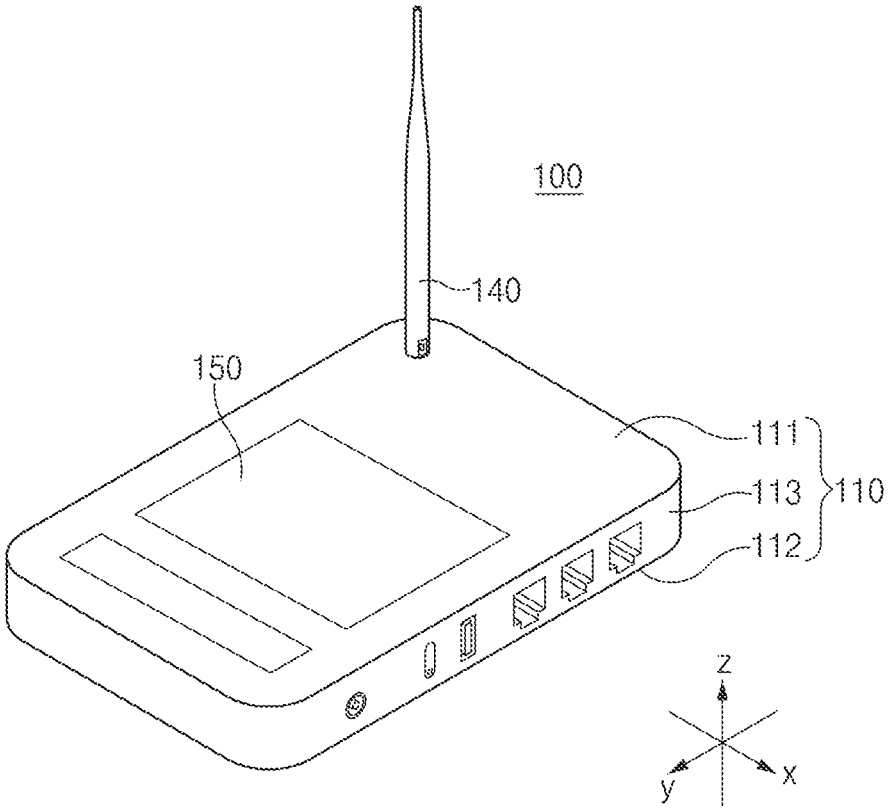
FIG. 1 is a perspective view illustrating an electronic device according to an embodiment of the disclosure.

FIG. 1 is a perspective view illustrating an electronic device according to an embodiment of the disclosure.

Referring to FIG. 1, an electronic device 100 may include a housing 110, and first and second antennas 150 and 140.

The housing 110 may form an appearance of the electronic device 100. For example, the housing 110 may include a first surface 111, a second surface 112 facing the first surface 111, and a side surface 113 surrounding between the first and second surfaces 111 and 112. For example, the first surface 111 may form an outer appearance in direction 'z' of the electronic device 100 and the second surface 112 may form an outer appearance in direction '−z' of the electronic device 100. The side surface 113 may form outer appearances in directions, 'x', '−x', 'y' and '−y' of the electronic device 100.

According to an embodiment, the housing 110 may protect various kinds of components included in the electronic device 100 from external impact. For example, a printed circuit board (PCB), a converter, and the like may be included in the electronic device 100, and the housing 110 may protect the components from external impact.

The electronic device 100 may communicate with an external device. For example, the electronic device 100 may receive a signal from a user terminal (e.g., an electronic device 801 of FIG. 8) and transmit the signal to a network. As another example, the electronic device 100 may transmit the signal received from the network to the user terminal. In the disclosure, the electronic device 100 may be referred to as an access point (AP) or a router.

According to an embodiment, the electronic device 100 may transmit/receive a signal through the first antenna 150 to/from a base station. For example, the first antenna 150 may include a spacer attached to the first surface 111 to transmit/receive a signal at a high rate to/from the base station.

According to an embodiment, the electronic device 100 may convert data received through the first antenna 150 into a Wi-Fi or local area network (LAN) signal. The Wi-Fi or LAN signal may be transmitted through the second antenna 140 to another electronic device in a house or building in which the electronic device 100 is installed. Locations and shapes of the first and second antennas 150 and 140 are not limited to those illustrated in FIG. 1, and the electronic device 100 may include another type of an internal antenna.

According to an embodiment, the electronic device 100 may transmit/receive a signal in a specified frequency band. For example, the electronic device 100 may transmit or receive a signal in about 28 GHz band in direction 'z'.

Figure 2:
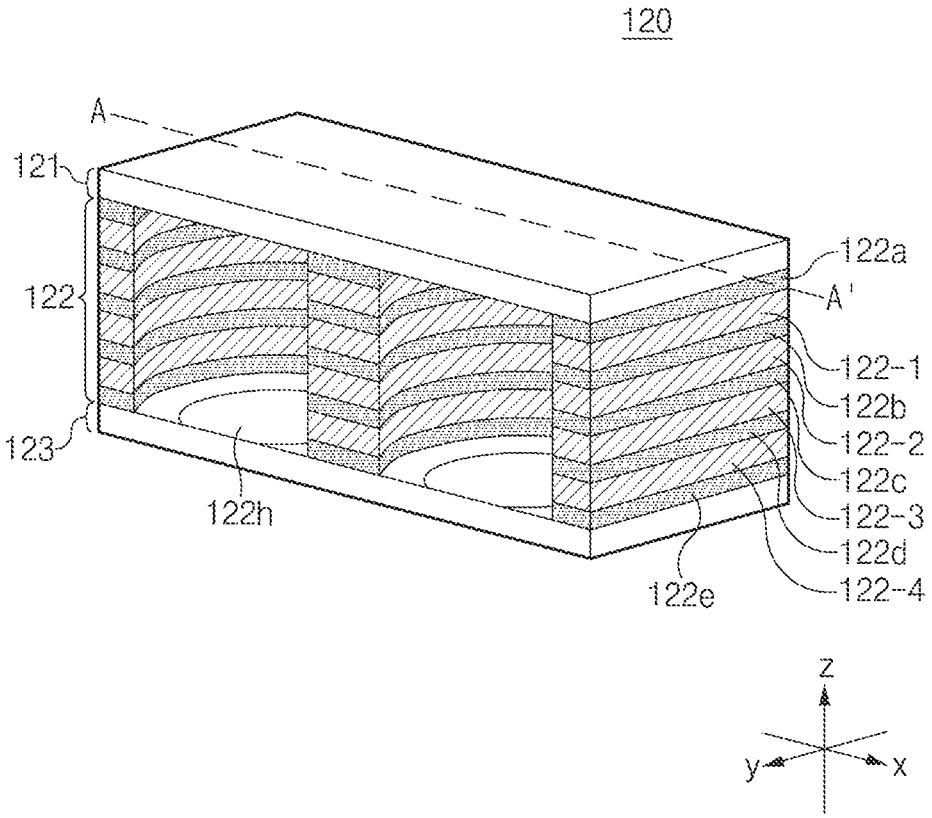
FIG. 2 is a perspective view illustrating a printed circuit board (PCB) according to an embodiment of the disclosure.

FIG. 2 is a perspective view illustrating a PCB according to an embodiment of the disclosure.

A PCB 120 illustrated in FIG. 2 may be included in the electronic device 100 illustrated in FIG. For example, the PCB 120 may be arranged in the housing 110 illustrated in FIG. 1. The PCB 120 may be arranged between the first and second surfaces 111 and 112.

Referring to FIG. 2, the PCB 120 may include a second substrate 121, a first substrate 123 and a spacer 122. The second substrate 121 may be parallel with the first substrate 123. The first and second substrates 123 and 121 may be formed of a non-conductive material (e.g., plastic). As another example, the first and second substrates 123 and 121 may include a plurality of non-conductive layers and a plurality of conductive layers. The spacer 122 may be arranged between the first and second substrates 123 and 121 and be formed in a portion thereof with an opening 122*h*. In the disclosure, the first and second substrates 123 and 121 may be referred to as first and second layers, respectively, or first and second regions, respectively. In the disclosure, spacer 122 may be referred to as a side member.

According to an embodiment, the spacer 122 may include a plurality of layers 122*a* to 122*e* and 122-1 to 122-4. For example, the spacer 122 may include a plurality of conductive layers 122*a* to 122*e* and a plurality of non-conductive layers 122-1 to 122-4. According to an embodiment, the conductive layers 122*a* to 122*e* and the non-conductive layers 122-1 to 122-4 may be alternately stacked. For example, a first non-conductive layer 122-1 may be interposed between first and second conductive layers 122*a* and 122*b*, and a second non-conductive layer 122-2 may be interposed between the second conductive layer 122*b* and a third conductive layer 122*c*. According to an embodiment, the non-conductive layers 122-1 to 122-4 may be formed of a non-conductive material (e.g., plastic). The conductive layers 122*a* to 122*e* may be formed of a conductive material (e.g., copper (Cu)).

According to an embodiment, adhesive material may be interposed between the second substrate 121 and the spacer 122 and between the spacer 122 and the first substrate 123. For example, the adhesive materials may allow the second substrate 121 and the spacer 122 to adhere to each other and allow the spacer 122 and the first substrate 123 to adhere to each other.

Figure 3:
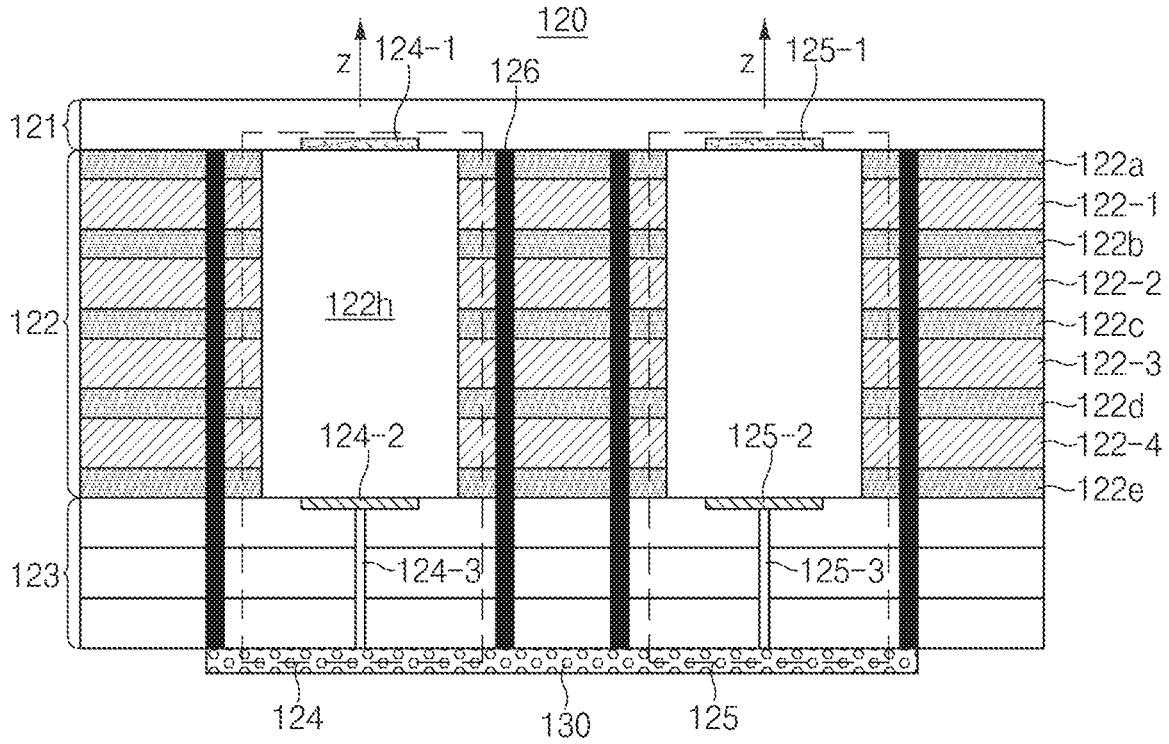
FIG. 3 is a sectional view illustrating a PCB according to an embodiment of the disclosure.

FIG. 3 is a sectional view illustrating a PCB according to an embodiment of the disclosure. The sectional view illustrated in FIG. 3 is taken along line A-A' of the PCB 120 illustrated in FIG. 2.

Referring to FIG. 3, the PCB 120 may include at least one antenna unit 124 and 125 and a via 126. Each of the antenna units 124 and 125 may include a director 124-1 or 125-1, a patch-type radiator 124-2 or 125-2, and a feeder 124-3 or 125-3. The communication circuit 130 may be arranged in the PCB 120 or coupled to the PCB 120. Although the communication circuit 130 arranged under the PCB 120 is illustrated in FIG. 3, the location of the communication circuit 130 is not limited thereto. For example, the communication circuit 130 may be arranged on a side surface of the PCB 120 and may be electrically connected to the antenna units 124 and 125 through specified wires (e.g., a flexible printed circuit board). The first and second antenna units 124 and 125 are illustrated in FIG. 3, but the following description will be focused on the first antenna unit 124. In the disclosure, the communication circuit 130 may be referred to as an external part. In the disclosure, director 124-1 or 125-1 may be referred to as a first conductive member. In the disclosure, patch-type radiator 124-2 or 125-2 may be referred to as a second conductive member.

According to an embodiment, the director 124-1 may be formed on the second substrate 121. For example, the director 124-1 may be formed on a surface of the second substrate 121 or inside the second substrate 121. As another example, the second substrate 121 may include a plurality of layers, and the director 124-1 may be arranged on one of the layers. In the disclosure, the director 124-1 may be referred to as an inducer.

According to an embodiment, the patch-type radiator 124-2 may be formed on the first substrate 123. For example, the patch-type radiator 124-2 may be formed on a surface of the first substrate 123 or inside the first substrate 123.

According to an embodiment, the director 124-1 and the patch-type radiator 124-2 may be spaced apart from each other by the spacer 122. For example, since the spacer 122 is interposed between the second substrate 121 and the first substrate 123, the director 124-1 and the patch-type radiator 124-2 may be spaced apart from each other by the spacer 122.

According to an embodiment, the director 124-1 and the patch-type radiator 124-2 face each other through the opening 122*h*. A dielectric material (e.g., air) may be provided in the opening 122*h*, where the permittivity of the dielectric material may be a specific value or less.

According to an embodiment, the feeder 124-3 may electrically connect the patch-type radiator 124-2 to the communication circuit 130. For example, when the communication circuit 130 is coupled to the first substrate 123, the feeder 124-3 may pass through the first substrate 123 to connect the patch-type radiator 124-2 to the communication circuit 130.

According to an embodiment, the director 124-1, the patch-type radiator 124-2 and the feeder 124-3 may be formed of a metallic material (e.g., Cu). For example, a current may flow through the director 124-1, the patch-type radiator 124-2 and the feeder 124-3.

According to an embodiment, the communication circuit 130 may feed power to the feeder 124-3. In the disclosure, the term "feeding" may mean an operation of applying a current to the feeder 124-3 by the communication circuit 130. When a current is fed, the communication circuit 130 may transmit/receive a signal in a specified frequency band (e.g., about 28 GHz) based on the electric path formed through the feeder 124-3 and the patch-type radiator 124-2.

According to an embodiment, the director 124-1 may induce the signal, which the communication circuit 130 transmits/receive, in a specified direction. For example, the director 124-1 may induce the signal such that the signal is radiated in direction 'z' or fed in direction '-z'. Since the signal radiated or fed through the director 124-1 is concentrated, the strength may be enhanced.

According to an embodiment, the via 126 may be provided between the antenna units 124 and 125, such that the electromagnetic interference between the antenna units 124 and 125 may be reduced. For example, the via 126 may reduce the electromagnetic interference between the first and second antenna units 124 and 125. Although the vias 126 provided on both sides of each antenna unit are illustrated in FIG. 3 that is a sectional view of the PCB 120, a plurality of vias may surround the patch-type radiator 124-2 or the opening 122*h*.

In the disclosure, the contents described in FIGS. 1 to 3 may be applied to the components that have the same reference numeral as the electronic device 100 and the PCB 120 illustrated in FIGS. 1 to 3. In addition, the PCB 120 and the communication circuit 130 illustrated in FIGS. 1 to 3 may include the first antenna 150. In the document, the director 124-1 and the patch-type radiator 124-2 may be referred to as first and second conductive member, respectively.

Figure 4:
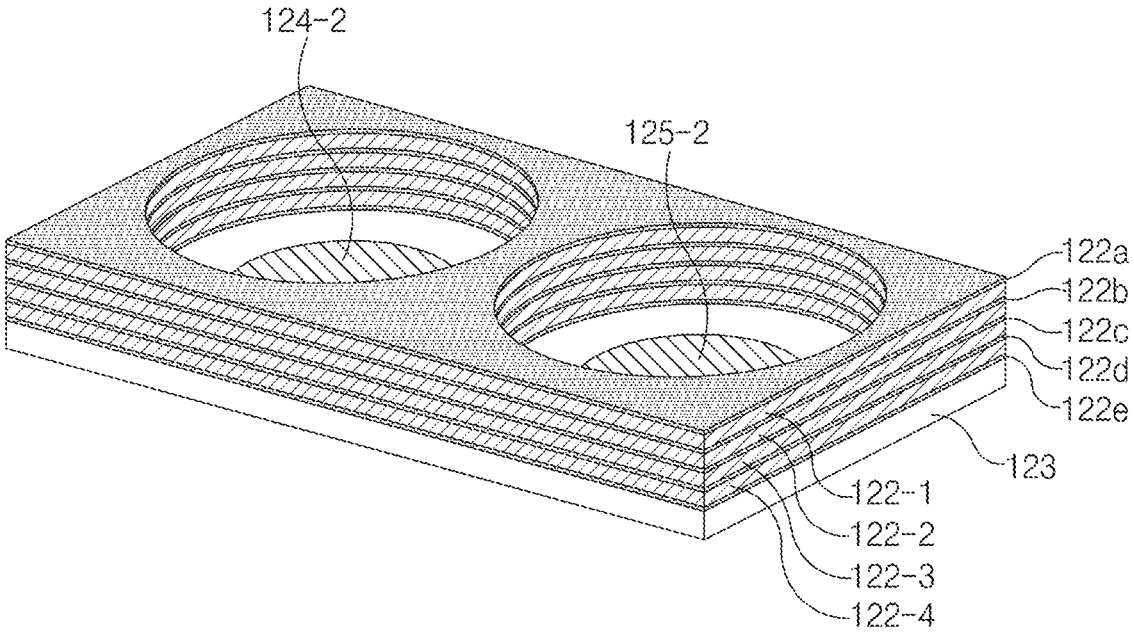
FIG. 4 is a view illustrating a part of a PCB according to an embodiment of the disclosure.

FIG. 4 is a view illustrating a part of a PCB according to an embodiment of the disclosure. FIG. 4 illustrates the PCB 120 from which the second substrate 121 is removed.

Referring to FIG. 4, the non-conductive layers 122-1 to 122-4 and the conductive layers 122*a* to 122*e* may be alternately stacked on the first substrate 123. For example, the fifth conductive layer 122*e* may be stacked on the first substrate 123 and the fourth non-conductive layer 122-4 may be stacked on the fifth conductive layer 122*e*. The other conductive and non-conductive layers 122*a* to 122*d* and 122-1 to 122-3 may be alternately stacked on the fourth non-conductive layer 122-4.

According to an embodiment, the patch-type radiators 124-2 and 125-2 may be mounted on the first substrate 123. For example, the patch-type radiators 124-2 and 125-2 may be arranged on the surface of the first substrate 123 or inside the first substrate 123, such that the patch-type radiators 124-2 and 125-2 at least partially overlap the opening 122*h* formed in the PCB when viewed from above the second substrate 121. The patch-type radiators 124-2 and 125-2 may transmit/receive a signal through a hole formed between the non-conductive and conductive layers 122-1 to 122-4 and 122*a* to 122*e*.

Figure 5A:
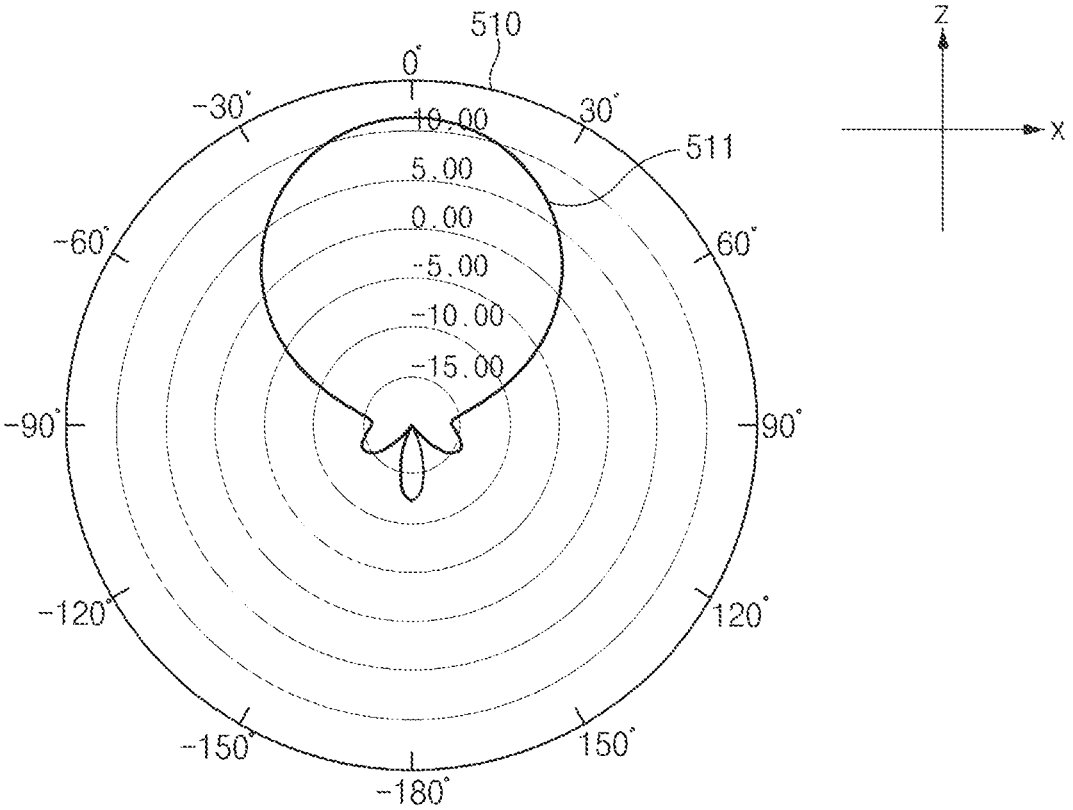
FIG. 5A is a view illustrating a gain of an electronic device according to an embodiment of the disclosure.

FIG. 5A is a view illustrating a gain of an electronic device according to an embodiment of the disclosure.

Referring to FIG. 5A, the electronic device according to a comparative example may mean an electronic device that does not include the PCB 120 illustrated in FIG. 2.

Figure 5B:
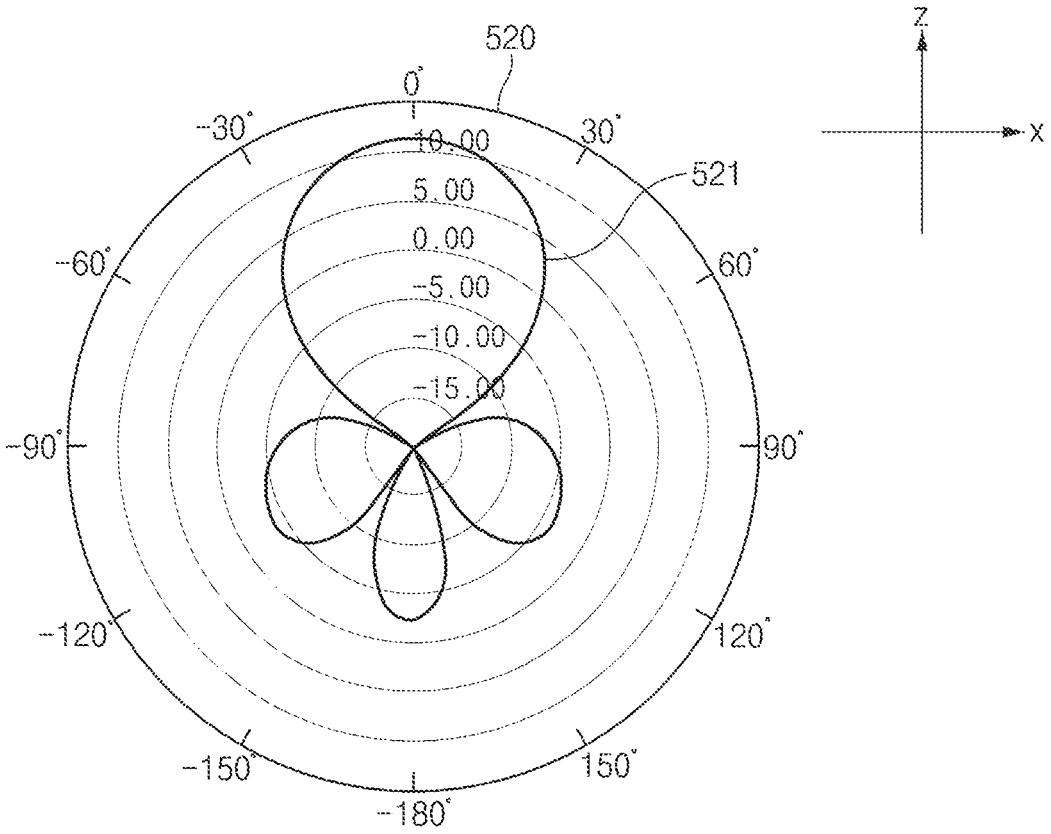
FIG. 5B is a view illustrating a gain of an electronic device according to an embodiment of the disclosure.

FIG. 5B is a view illustrating a gain of an electronic device according to an embodiment of the disclosure.

Referring to FIG. 5B, the gain of the electronic device 100 illustrated in FIG. 1.

The planes 510 and 520 illustrated in FIGS. 5A and 5B may mean x-z or y-z planes when it is assumed that the electronic device according to the comparative example and the electronic device 100 are located at the center of a rectangular coordinate system, respectively. For example, when the planes 510 and 520 illustrated in FIGS. 5A and 5B are x-z planes, 0° may mean the direction 'z', −180° may mean the direction '−z', 90° may mean the direction 'x', and −90° may mean the direction '−x'. Hereinafter, it will be assumed that the planes 510 and 520 are x-z planes.

Referring to a graph 511, the electronic device according to the comparative example may have a gain of about 10 dB in the z direction. However, the electronic device according to the comparative example may have a very small gain in the −z, x and −x directions. For example, the electronic device according to the comparative example may radiate a signal having a strong intensity in the z direction, but may radiate only a signal having a very weak intensity in the −z, x and −x directions.

Referring to a graph 521, the electronic device 100 according to an embodiment may have a gain of about 10 dB in the z direction. The electronic device 100 according to an embodiment may have a gain of about −5 dB in the −z, x, and −x directions. In other words, the electronic device 100 according to an embodiment of the disclosure may radiate a stronger signal in the −z, x and −x directions than the electronic device according to the comparative example.

Figure 6A:
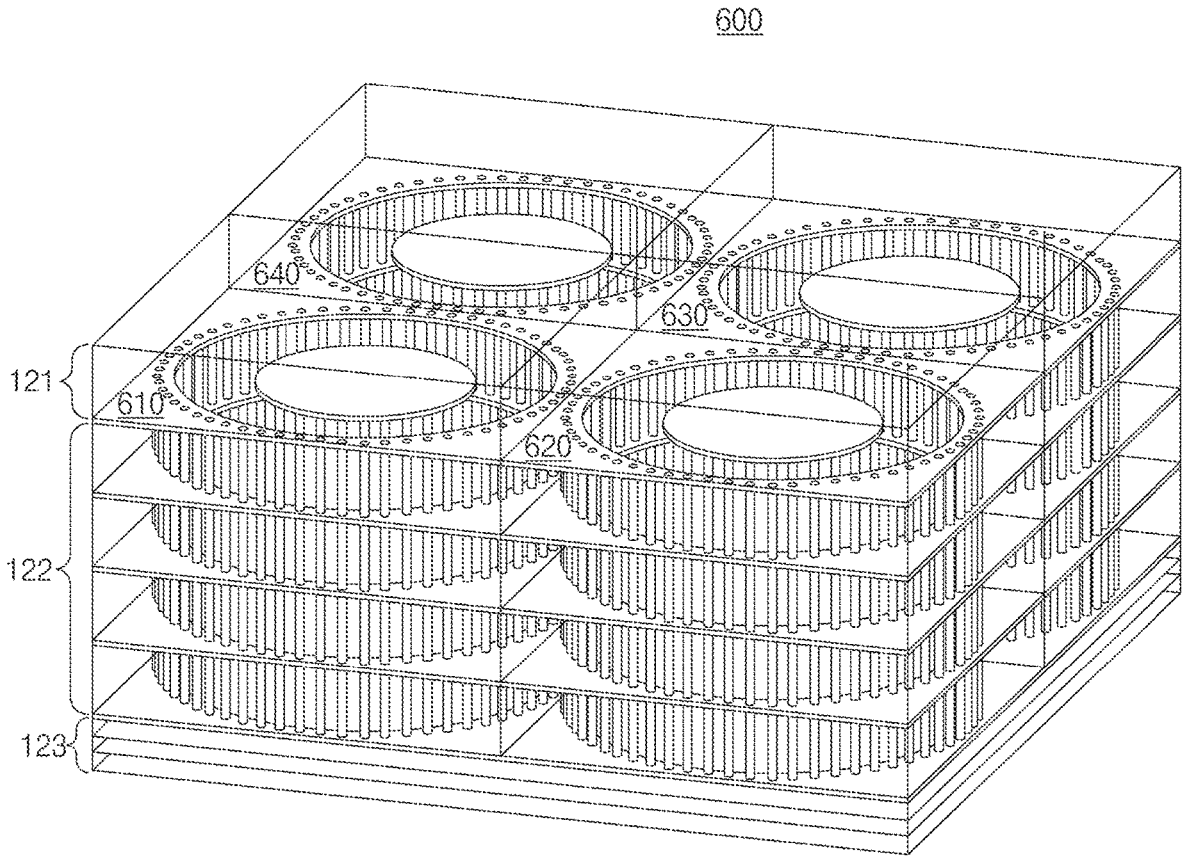
FIG. 6A is a perspective view illustrating a PCB according to an embodiment of the disclosure.

FIG. 6A is a perspective view illustrating a PCB according to an embodiment of the disclosure.

Referring to FIG. 6A, a PCB 600 may be included in the electronic device 100 illustrated in FIG. 1. For example, the PCB 600 may be arranged inside the housing 110 illustrated in FIG. 1. The PCB 600 may be arranged between the first and second surfaces 111 and 112.

The PCB 120 illustrated in FIG. 2 may be substantially the same as or similar to the PCB 600 illustrated in FIG. 6A except for the number of mounted antenna units. First to fourth antenna units 610 to 640 may be substantially the same as or similar to the first antenna unit 124 illustrated in FIG. 3. For example, the first to fourth antenna units 610 to 640 may include the director 124-1, the patch-type radiator 124-2, and the feeder 124-3. As another example, the director 124-1 and the patch-type radiator 124-2 may be spaced apart from each other by the spacer 122.

Although not illustrated in FIG. 6A, according to an embodiment, the communication circuit 130 may be arranged under the PCB 600. The communication circuit 130 may feed power to the first to fourth antenna units 610 to 640. The communication circuit 130 may radiate a signal in a specified frequency band based on the electric path formed through the first to fourth antenna units 610 to 640.

Figure 6B:
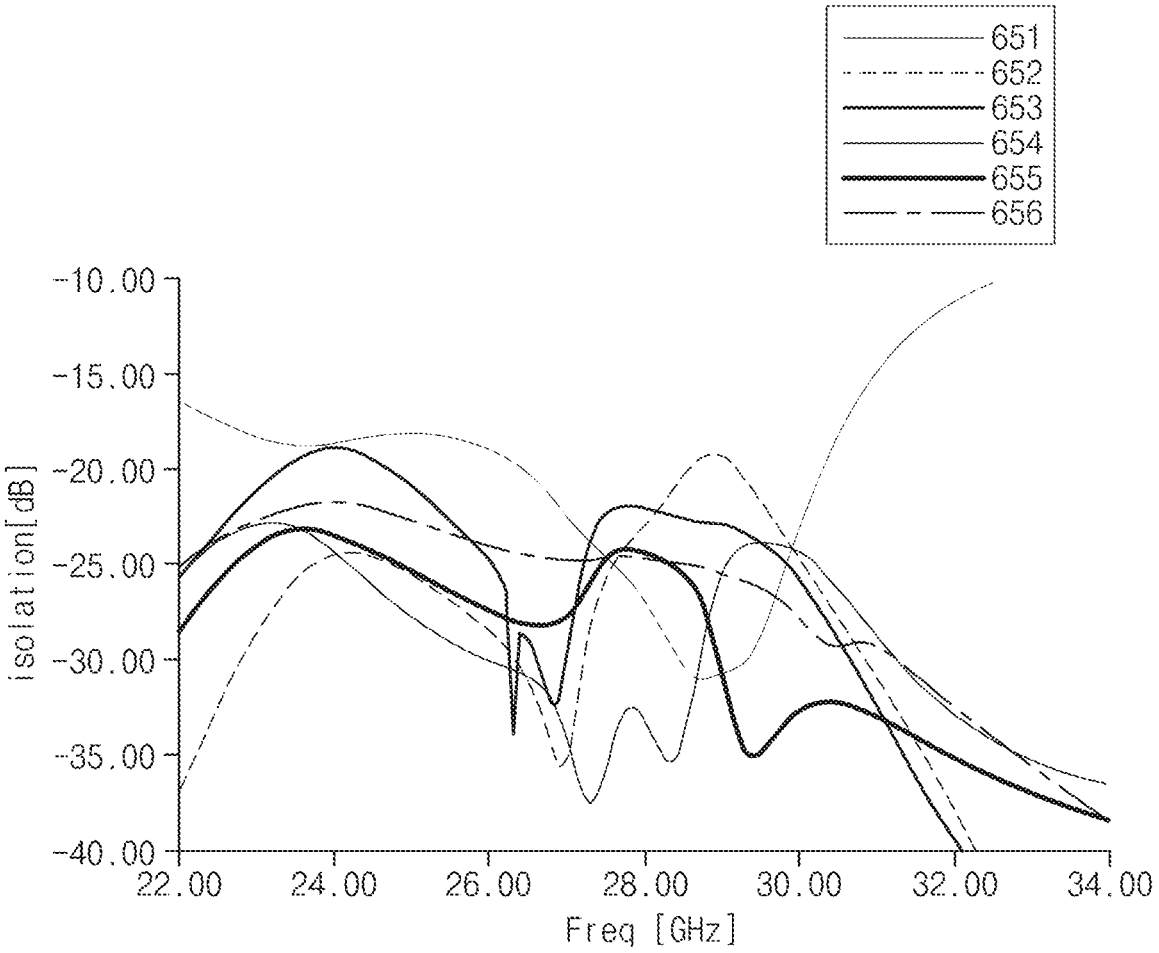
FIG. 6B is a view illustrating an isolation of an electronic device according to an embodiment of the disclosure.

FIG. 6B is a view illustrating an isolation of an electronic device according to an embodiment of the disclosure.

Referring to FIG. 6B, graphs 651 to 656 illustrate isolations between the antenna units 610 to 640 illustrated in FIG. 6A. For example, the graph 651 illustrates the isolation between the first and second antenna units 610 and 620, and the graph 652 illustrates the isolation between the first and third antenna units 610 and 630. The graph 653 illustrates the isolation between the first and fourth antenna units 610 and 640, and the graph 654 illustrates the isolation between the second and third antenna units 620 and 630. The graph 655 illustrates the isolation between the second and fourth antenna units 620 and 640, and the graph 656 illustrates the isolation between the third and fourth antenna units 630 and 640.

Referring to the graphs 651 to 656, it may be confirmed that the isolations of the graphs 651 to 656 are good in a specified frequency band (e.g., 28 GHz). For example, in the case of the graph 651, it may be confirmed that the isolation in the 28 GHz band is better than the isolation in 32 GHz or above. In the case of the graph 653, the isolation in the 28 GHz band is better than that in 24 GHz band. For example, in all the graphs 651 to 656, in common, very good isolations (e.g., 15 dB or less) may be given in 28 GHz band. For example, the electronic device 100 may radiate a signal in 28 GHz band in which the isolation is best.

Figure 6C:
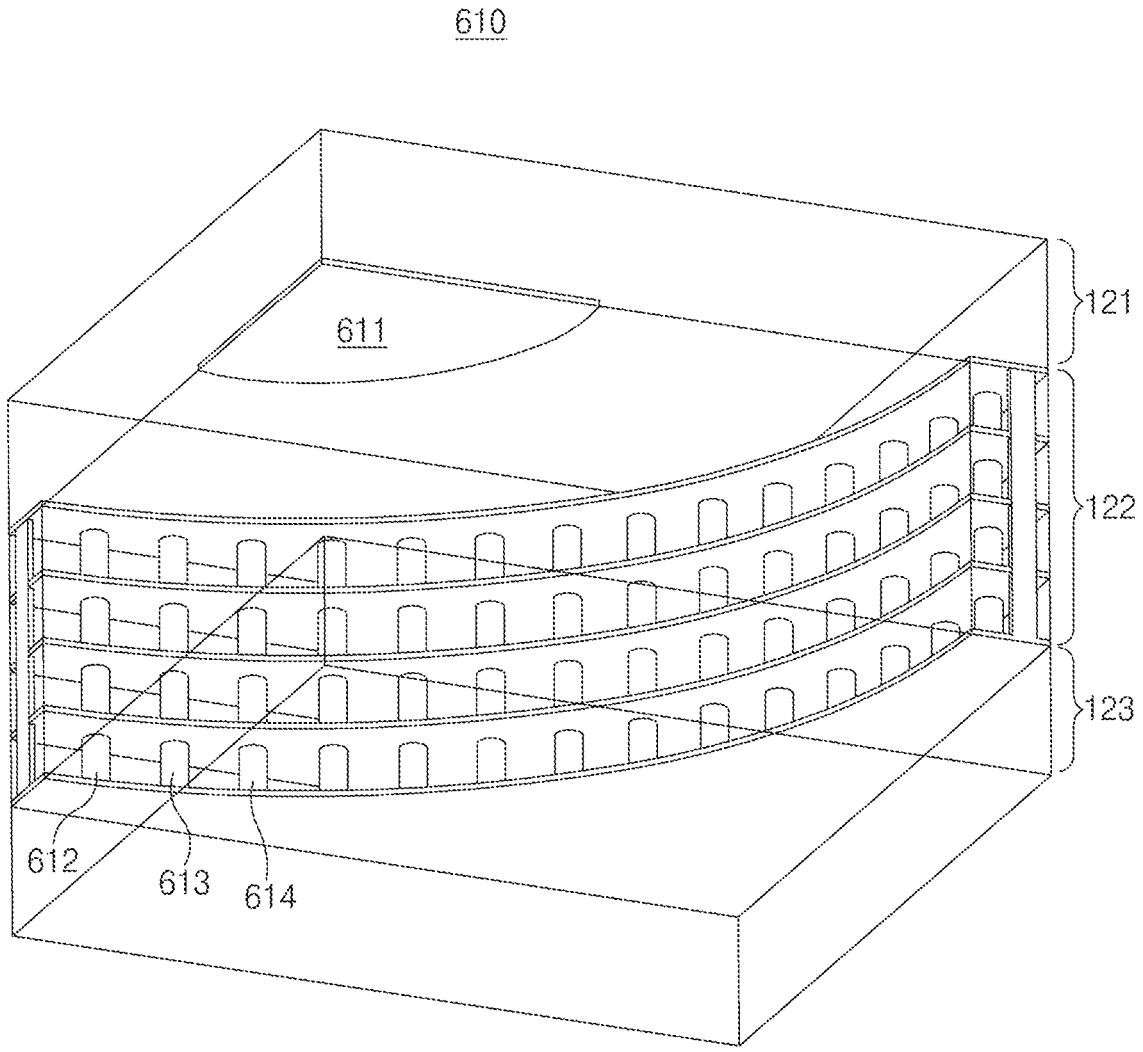
FIG. 6C is a view illustrating an antenna unit according to an embodiment of the disclosure.
Figure 6D:
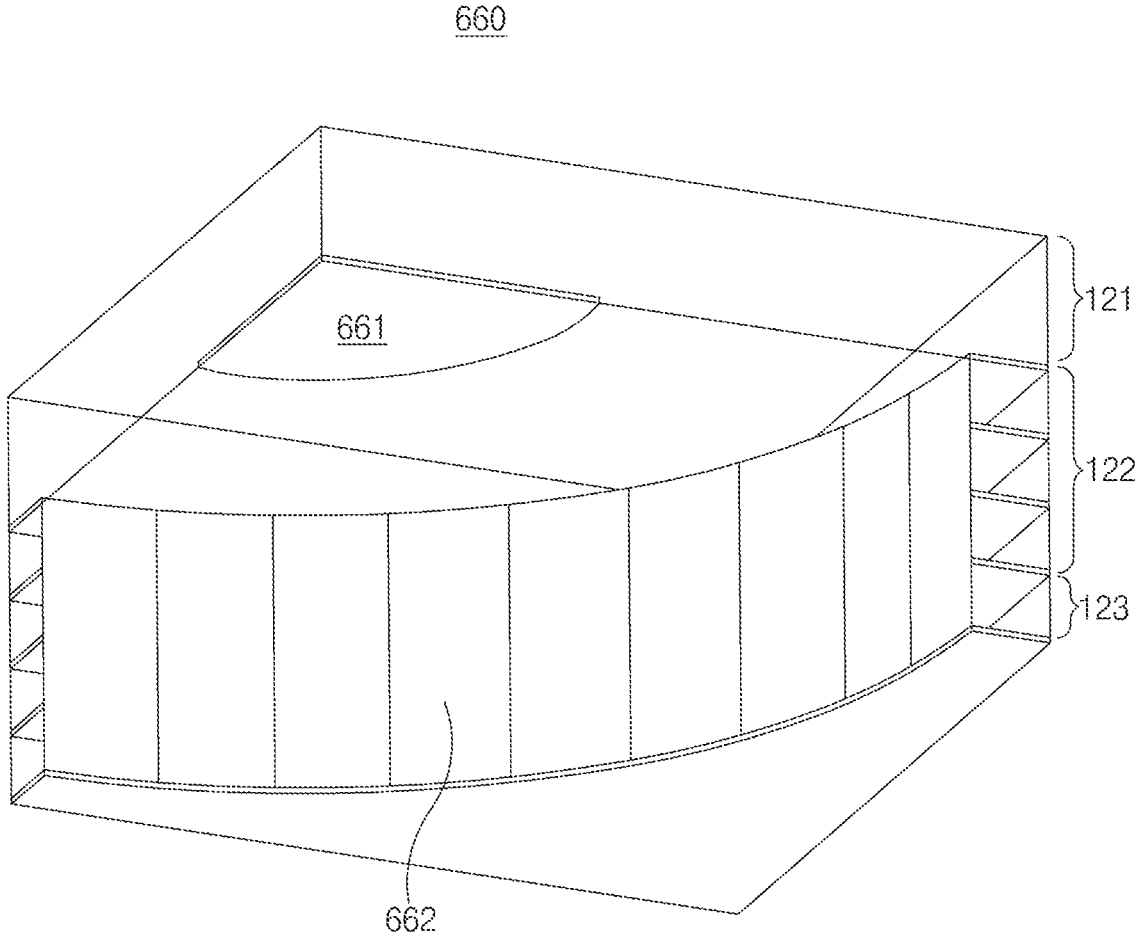
FIG. 6D is a view illustrating an antenna unit according to an embodiment of the disclosure.

FIG. 6C is a view illustrating an antenna unit according to an embodiment of the disclosure. FIG. 6D is a view illustrating an antenna unit according to an embodiment of the disclosure. The antenna unit 610 illustrated in FIG. 6C and the antenna unit 660 illustrated in FIG. 6D may be included in the PCB 600 illustrated in FIG. 6A.

Referring to FIG. 6C, the antenna unit 610 may include the second substrate 121, the first substrate 123 and the spacer 122. According to an embodiment, a director 611 may be formed in the second substrate 121. Although not illustrated, a patch-type radiator may be formed in the first substrate 123.

According to an embodiment, the director 611 and the patch-type radiator may face each other through an inner space of the spacer 122. A plurality of vias 612 to 614 may surround the inner space. When a signal is transmitted/received through the antenna unit 610, the vias 612 to 614 may reduce the electromagnetic interference with another antenna unit (e.g., 620 of FIG. 6A).

Referring FIG. 6D, the antenna unit 660 may be arranged on the second substrate 121, the first substrate 123 and the spacer 122. For example, a director 661 may be formed on the second substrate 121. Although not illustrated, the patch-type radiator may be formed on the first substrate 123.

According to an embodiment, the director 661 and the patch-type radiator may face each other through the inner space of the spacer 122. According to an embodiment, a circumference of at least one inner space included in the spacer 122 may be surrounded by a via hole or a conductive material. When a signal is transmitted/received through the antenna unit 660, a side surface of the spacer 122 may reduce the electromagnetic interference with another antenna unit. According to an embodiment, a side surface 662 of the spacer 122 may be plated or surrounded by a conductive material (e.g., aluminum (Al) or Cu).

Figure 6E:
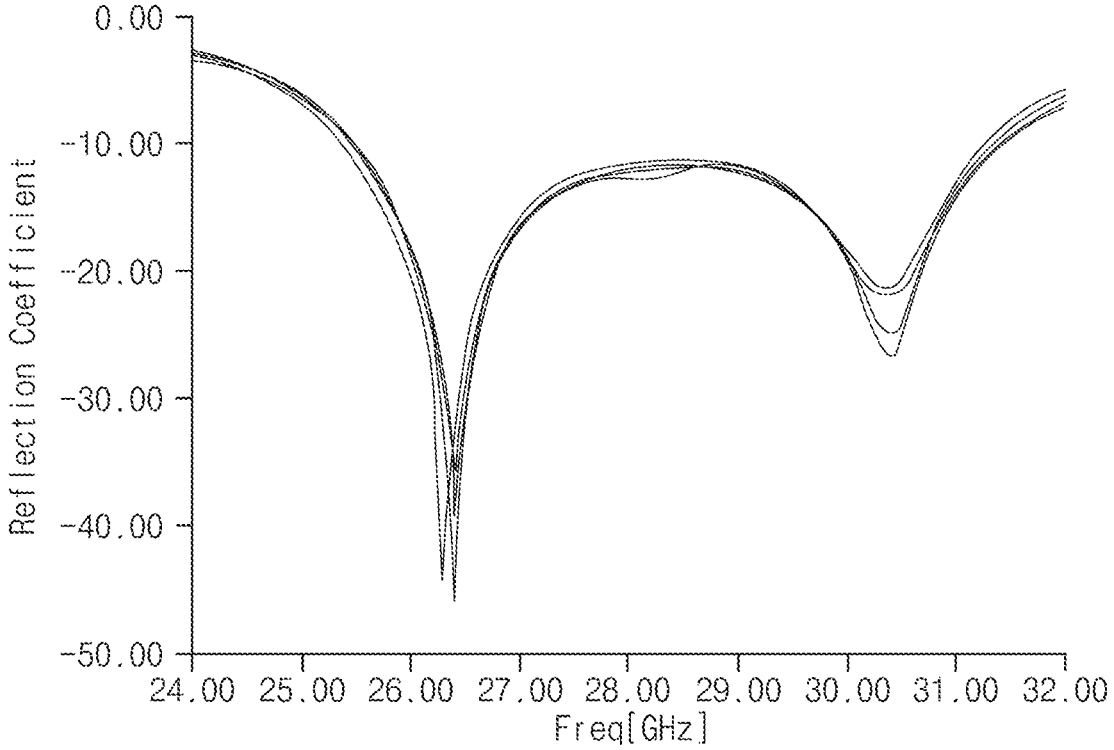
FIG. 6E is a view illustrating a reflection coefficient of an electronic device according to an embodiment of the disclosure.
Figure 6F:
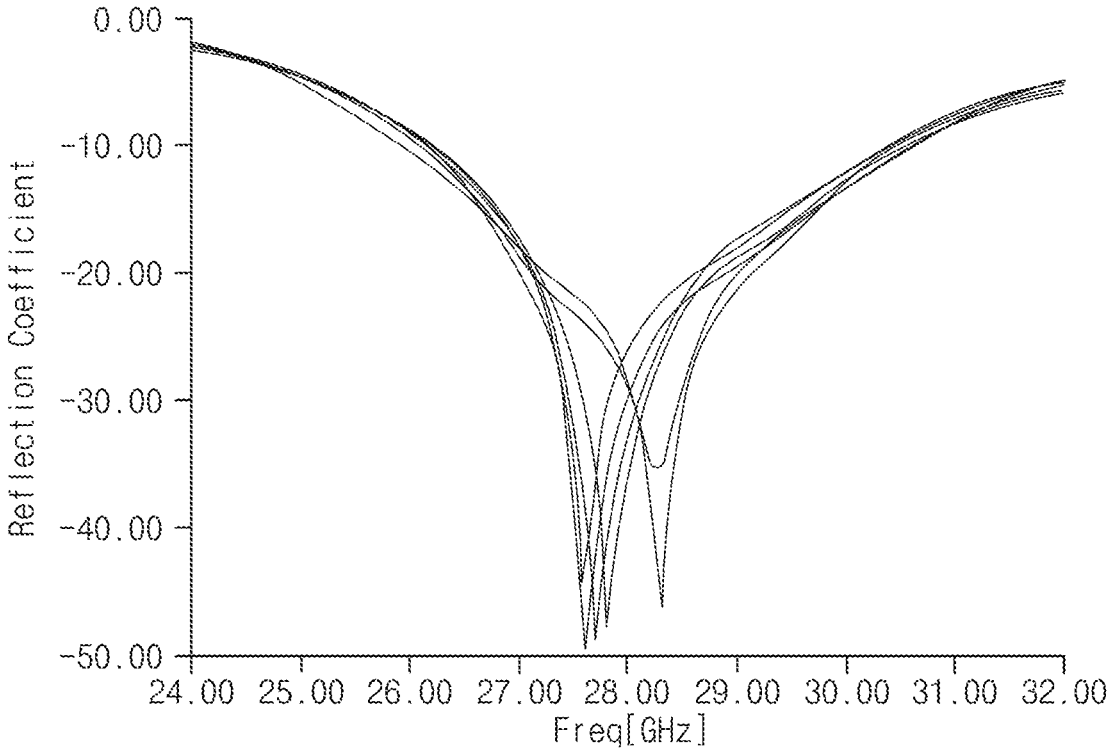
FIG. 6F is a view illustrating a reflection coefficient of an electronic device according to an embodiment of the disclosure.
Figure 6G:
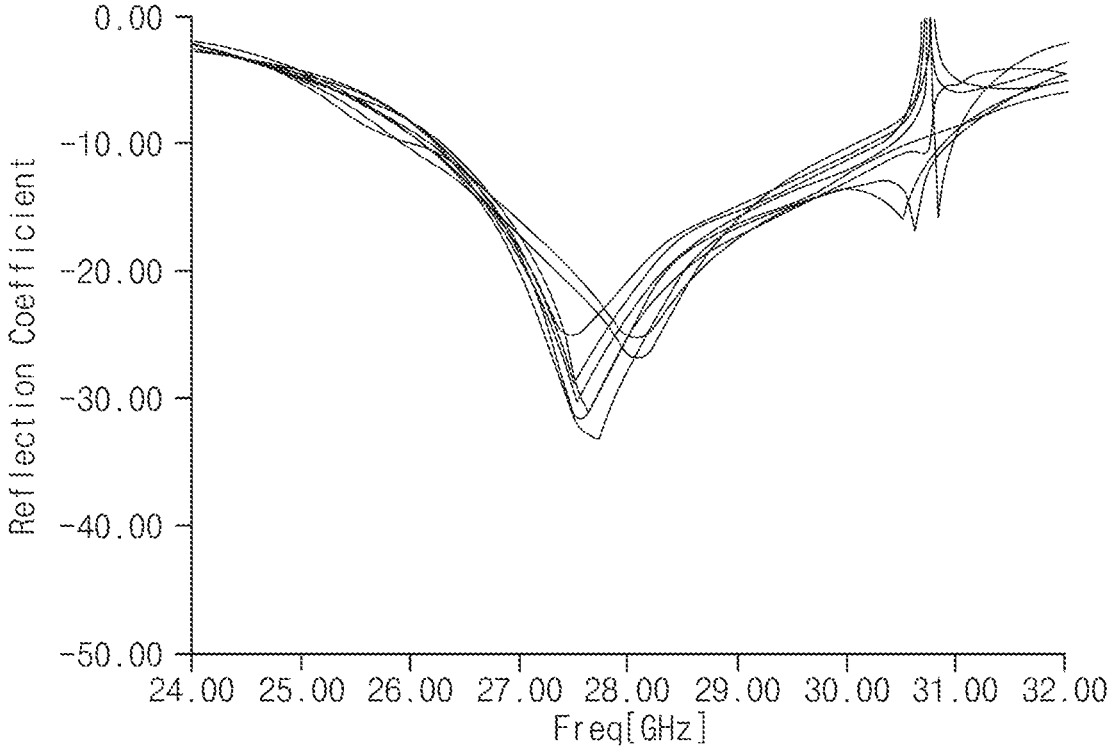
FIG. 6G is a view illustrating a reflection coefficient of an electronic device according to an embodiment of the disclosure.

FIG. 6E is a view illustrating reflection coefficients of antenna units included in an electronic device according to an embodiment of the disclosure. FIG. 6F is a view illustrating reflection coefficients of antenna units included in an electronic device according to an embodiment of the disclosure. FIG. 6G is a view illustrating reflection coefficients of antenna units included in an electronic device according to an embodiment of the disclosure.

Referring to FIG. 6E, the graphs illustrated represent a reflection coefficient of an electronic device including an antenna unit (e.g., the antenna unit 660 including the spacer 122 plated by Al of FIG. 6D). Referring to FIG. 6F, the graphs illustrated represent a reflection coefficient of an electronic device including the antenna unit 610. Referring to FIG. 6G, the graphs illustrated represent a reflection coefficient of an electronic device including an antenna unit (e.g., the antenna unit 660 including the spacer 122 plated by Cu of FIG. 6D).

TABLE 1

| Performance | Scheme of implementing side surface of spacer 122 | | | |
|---|---|---|---|---|
| comparison | Aluminum | Via | Copper | Remarks |
| Gain[dB] | 16.1 | 15.9 | 15.9 | Main beam |
| HPBW[deg] | 24° | 24° | 24° | Main beam |
| BW[GHz] | 5.8 | 4.1 | 3.8 | $S_{11}$ −10 dB |
| Isolation[dB] | −18.5 | −16.5 | −16 | All ports |

Table 1 illustrates a gain, a half power beam width, a bandwidth, and an isolation of an electronic device.

Referring to the graphs illustrated in FIGS. 6E to 6G and the Table 1, when the side surface of the spacer 122 is formed of Al (hereinafter, referred to as a first case), the electronic device may transmit/receive a signal of about 26 GHz band or about 30.5 GHz band. When the side surface of the spacer 122 includes vias (hereinafter, referred to as a second case) and the side surface of the spacer 122 is formed of copper (hereinafter, referred to as a third case), the electronic device may transmit/receive a signal of about 28 GHz band.

According to an embodiment, in all the cases, the gains and the half power beam widths are equal to or similar to each other. For example, in all the first to third cases, the electronic device may transmit/receive signals having the same intensity or similar intensities in a specific direction.

According to an embodiment, since the bandwidth of the first case is 5.8 GHz and the bandwidth of the second case is 4.1 GHz, the bandwidth of the first case may be larger than that of the second case. Since the bandwidth of the second case is 4.1 GHz and the bandwidth of the third case is 3.8 GHz, the bandwidth of the second case may be larger than that of the third case.

According to an embodiment, since the isolation of the first case is −18.5 dB and the isolation of the second case is −16.5 dB, the isolation of the second case may be better than that of the first case. Since the isolation of the second case is −16.5 dB and the isolation of the third case is −16.5 dB, the isolation of the third case may be better than that of the second case.

Figure 7A:
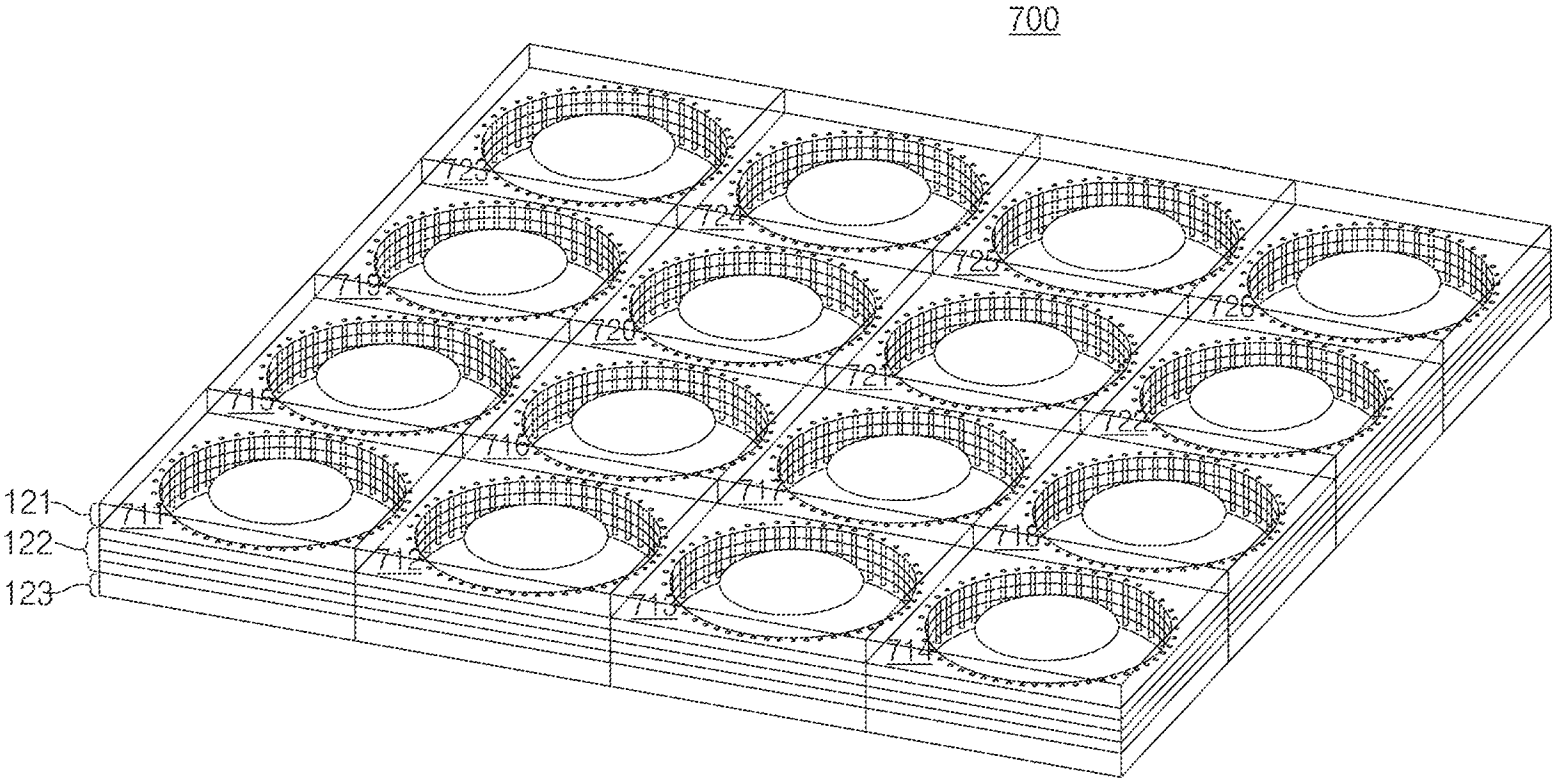
FIG. 7A is a perspective view illustrating a PCB according to an embodiment of the disclosure.

FIG. 7A is a perspective view illustrating a PCB according to an embodiment of the disclosure.

Referring to FIG. 7A, a PCB 700 may be included in the electronic device 100 illustrated in FIG. 1. For example, the PCB 700 may be arranged in the housing 110 illustrated in FIG. 1. The PCB 700 may be arranged between the first and second surfaces 111 and 112.

The PCB 600 illustrated in FIG. 6A may be substantially the same as or similar to the PCB 700 illustrated in FIG. 7A. Each of first to sixteenth antenna units 711 to 726 may be substantially the same as or similar to the first antenna unit 124 illustrated in FIG. 3. For example, each of the first to sixteenth antenna units 711 to 726 may include the director 124-1, the patch-type radiator 124-2, and the feeder 124-3. As still another example, the director 124-1 and the patch-type radiator 124-2 may be spaced apart from each other by the spacer 122.

Although not illustrated in FIG. 7A, according to an embodiment, the communication circuit 130 may be arranged under the PCB 700. The communication circuit 130 may feed power to the first to sixteenth antenna units 711 to 726. The communication circuit 130 may radiate a signal in a specified frequency band based on the electric path formed through the first to sixteenth antenna units 711 to 726. For example, the communication circuit 130 may radiate a signal in a frequency band in which the isolations between the first to sixteenth antenna units 711 to 726 are the best.

Figure 7B:
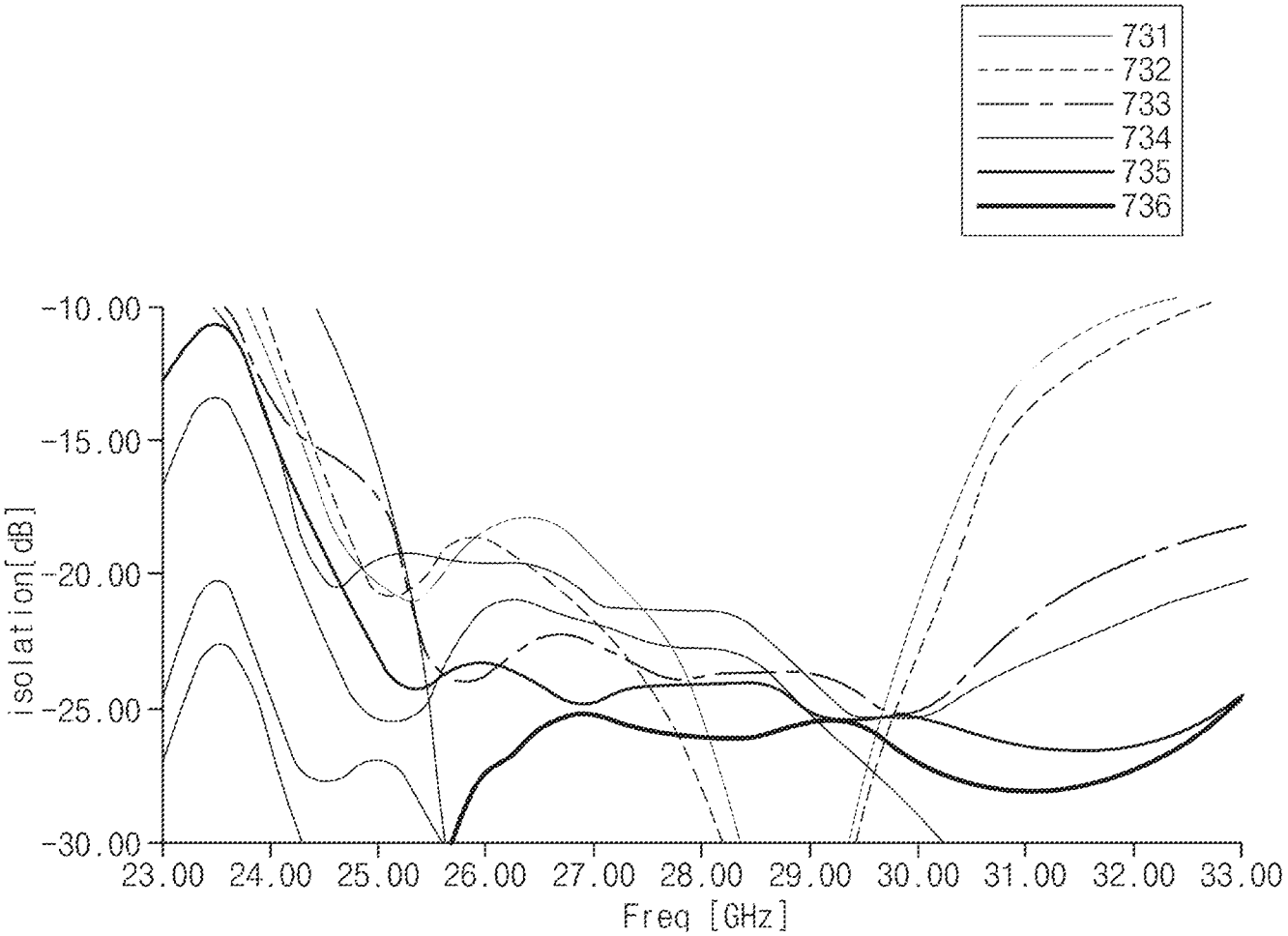
FIG. 7B is a view illustrating an isolation of an electronic device according to an embodiment of the disclosure.

FIG. 7B illustrates an isolation of an electronic device according to an embodiment of the disclosure.

Referring to FIG. 7B, graphs 731 to 736 illustrate isolations between the antenna units 711 to 726 illustrated in FIG. 7A. For example, the graph 731 illustrates the isolation between the first and second antenna units 711 and 712, and the graph 732 illustrates the isolation between the first and third antenna units 711 and 713. The graph 733 illustrates the isolation between the first and fourth antenna units 711 and 714, and the graph 734 illustrates the isolation between the first and fifth antenna units 711 and 715. The graph 735 illustrates the isolation between the first and sixth antenna units 711 and 716, and the graph 736 illustrates the isolation between the first and seventh antenna units 711 and 717. Although a total of 120 graphs may be illustrated in the above-described sequence, the description of the remaining graphs will be omitted for convenience of explanation.

Referring to the graphs 731 to 736, as illustrated in FIG. 6B, it may be confirmed that the isolations of the graphs 731 to 736 are good in a specified frequency band (e.g., 28 GHz). For example, in the case of the graph 731, it may be confirmed that the isolation in the 28 GHz band is better than the isolation in 32 GHz or above. In the case of the graph 733, the isolation in the 28 GHz band is better than that in 24 GHz band. For example, in all the graphs 731 to 736, in common, the isolations of a certain degree or above may be given in 28 GHz band. For example, the electronic device 100 may radiate a signal in 28 GHz band in which the isolation is best.

According to an embodiment of the disclosure, the electronic device 100 may include the housing 110 that includes the first surface 111, the second surface 112 facing the first surface 111, and the side surface 113 surrounding a space between the first and second surfaces 111 and 112, the PCB 120 that is arranged inside the housing 110 and includes at least one antenna unit, and the communication circuit 130 that is arranged inside the PCB 120 or between the PCB 120 and the housing 110, where the PCB 120 includes the first substrate 123, the second substrate 121 facing the first substrate 123, and the spacer 122 arranged between the first and second substrates 121 and 123 and formed on a specified region with the opening 122*h*, wherein each of the antenna units 124 and 125 includes the director 124-1 and 125-1 formed on the first substrate 123, the patch-type radiator 124-2 and 125-2 formed on the second substrate 121 and facing the director 124-1 and 125-1 through the opening 122*h*, and the feeder 124-3 and 125-3 connecting the patch-type radiators 124-2 and 125-2 to the communication circuit 130, and wherein the communication circuit 130 feeds power to the feeder 124-3 and 125-3 and transmits/receives a signal of a specified frequency band through an electrical path formed through the feeder 124-3 and 125-3 and the patch-type radiator 124-2 and 125-2.

According to an embodiment of the disclosure, a dielectric material may be provided in a space between the patch-type radiator 124-2 and 125-2 and the director 124-1 and 125-1.

According to an embodiment of the disclosure, each of the antenna units 124 and 125 may further include the plurality of vias 126 surrounding the opening 122*h*.

According to an embodiment of the disclosure, the at least one antenna unit may include the first and second antenna units 124 and 125, and the plurality of vias 126 may block interference between the first and second antenna units 124 and 125.

According to an embodiment of the disclosure, the first and second antenna units 124 and 125 may transmit/receive signals of mutually different frequency bands.

According to an embodiment of the disclosure, the director 124-1 and 125-1 and the patch-type radiator 124-2 and 125-2 may be formed of a conductive material.

According to an embodiment of the disclosure, there may be formed specified interval distances between the director 124-1 and 125-1 and the spacer 122 and between the spacer 122 and the patch-type radiator 124-2 and 125-2.

According to an embodiment of the disclosure, the first substrate 123 and the spacer 122 may adhere to each other by an adhesive material, and the spacer 122 and the second substrate 121 may adhere to each other by the adhesive material.

According to an embodiment of the disclosure, the spacer 122 may include the plurality of non-conductive layers 122-1 to 122-4 between which the conductive layers 122*a* to 122*e* are arranged, respectively.

According to an embodiment of the disclosure, the PCB 120 may be arranged between the patch-type radiator 124-2 and 125-2 and the spacer 122, and may further include a non-conductive material surrounding the patch-type radiator 124-2 and 125-2.

According to an embodiment of the disclosure, the PCB 120 may include the first layer 123, the second layer 121 facing the first layer 123, the side member 122 arranged between the first and second layers 123 and 121 and formed in a specified region with the opening 122*h*, the first conductive member 124-1 and 125-1 formed on the second layer 121, the second conductive member 124-2 and 125-2 formed on the first layer 123 and facing the first conductive member 124-1 and 125-1 through the opening 122*h*, and the feeder 124-3 and 125-3 connecting the second conductive member 124-2 and 125-2 to the external component 130.

According to an embodiment of the disclosure, the first and second layers 123 and 121 may be formed of a non-conductive material.

According to an embodiment of the disclosure, the PCB 120 may further include the plurality of vias 126 surrounding the opening 122*h*, and the vias 126 may extend from the first layer 123 to the second layer 121.

According to an embodiment of the disclosure, the first layer 123 and the side member 122 may adhere to each other by an adhesive material, and the side member 122 and the second layer 121 may adhere to each other by the adhesive material.

According to an embodiment of the disclosure, the side member 122 may include the plurality of non-conductive layers 122-1 to 122-4, and the conductive layers 122*a* to 122*e* may be arranged between the non-conductive layers 122-1 to 122-4, respectively.

According to an embodiment of the disclosure, specified interval distances may be formed between the first conductive member 124-1 and 125-1 and the side member 122 and between the second conductive member 124-2 and 125-2 and the side member 122.

According to an embodiment of the disclosure, the electronic device 100 may include the housing 110 that includes the first surface 111, the second surface 112 facing the first surface 111, and the side surface 113 surrounding a space between the first and second surfaces 111 and 112, and the PCB 120 that is arranged inside the housing 110 or is attached to the first surface 111, wherein the PCB 120 includes the at least one antenna unit 124 and 125 and the wireless communication circuit 130 electrically connected to each of the at least one antenna unit 124 and 125, wherein each of the antenna units includes the director 124-1 and 125-1 arranged in the second region 121, the patch-type radiator 124-2 and 125-2 arranged in the first region 123 facing the second region 121, and the feeder 124-3 and 125-3 electrically connecting the patch-type radiator 124-2 and 125-2 to the wireless communication circuit 130, and wherein the wireless communication circuit 130 feeds power to the feeder 124-3 and 125-3 and transmits/receives a signal of a specified frequency band through an electrical path formed through the feeder 124-3 and 125-3 and the patch-type radiator 124-2 and 125-2.

According to an embodiment of the disclosure, the PCB 120 may further include the spacer 122 that spaces the first and second regions 123 and 121 apart from each other, and the director 124-1 and 125-1 and the patch-type radiator 124-2 and 125-2 may face each other through the opening 122*h* formed in the spacer 122.

According to an embodiment of the disclosure, each of the antenna units 124 and 125 may further include the plurality of vias 126 surrounding the opening 122*h*.

According to an embodiment of the disclosure, the PCB 120 may include the first substrate 123 and the second substrate 121 facing the first substrate 123, wherein the spacer 122 is arranged between the first and second substrates 123 and 121, wherein the first region 123 includes at least a part of the first substrate 123, and wherein the second region 121 includes at least a part of the second substrate 121.

According to an embodiment of the disclosure, the electronic device 100 may include the housing 110, an antenna structure that includes the first substrate 123 including a plurality of conductive regions, the second substrate 121 formed of an insulating material, and the first plurality of insulating layers 122-1 to 122-4 and the second plurality of conductive layers 122*a* to 122*e* that are alternately stacked between the first and second substrates 123 and 121, wherein the first plurality of insulating layers 122-1 to 122-4 and the second plurality of conductive layers 122*a* to 122*e* form a plurality of inner spaces between the first and second substrates 123 and 121 such that the conductive regions are exposed to the inner spaces and located in the inner spaces when viewed from above the first substrate 123, and the wireless communication circuit 130 electrically connected to the conductive regions.

According to an embodiment of the disclosure, the wireless communication circuit 130 may be configured to transmit and/or receive a signal of a frequency band of 26 GHz to 31 GHz.

According to an embodiment of the disclosure, the second substrate 121 may be thicker than at least one of the first plurality of insulating layers 122-1 to 122-4.

According to an embodiment of the disclosure, the first plurality of insulating layers 122-1 to 122-4 may be formed through the insulating layers between two of the second plurality of conductive layers 122*a* to 122*e* and may include the plurality of vias 126 surrounding the inner spaces in the side surface 113.

Figure 8:
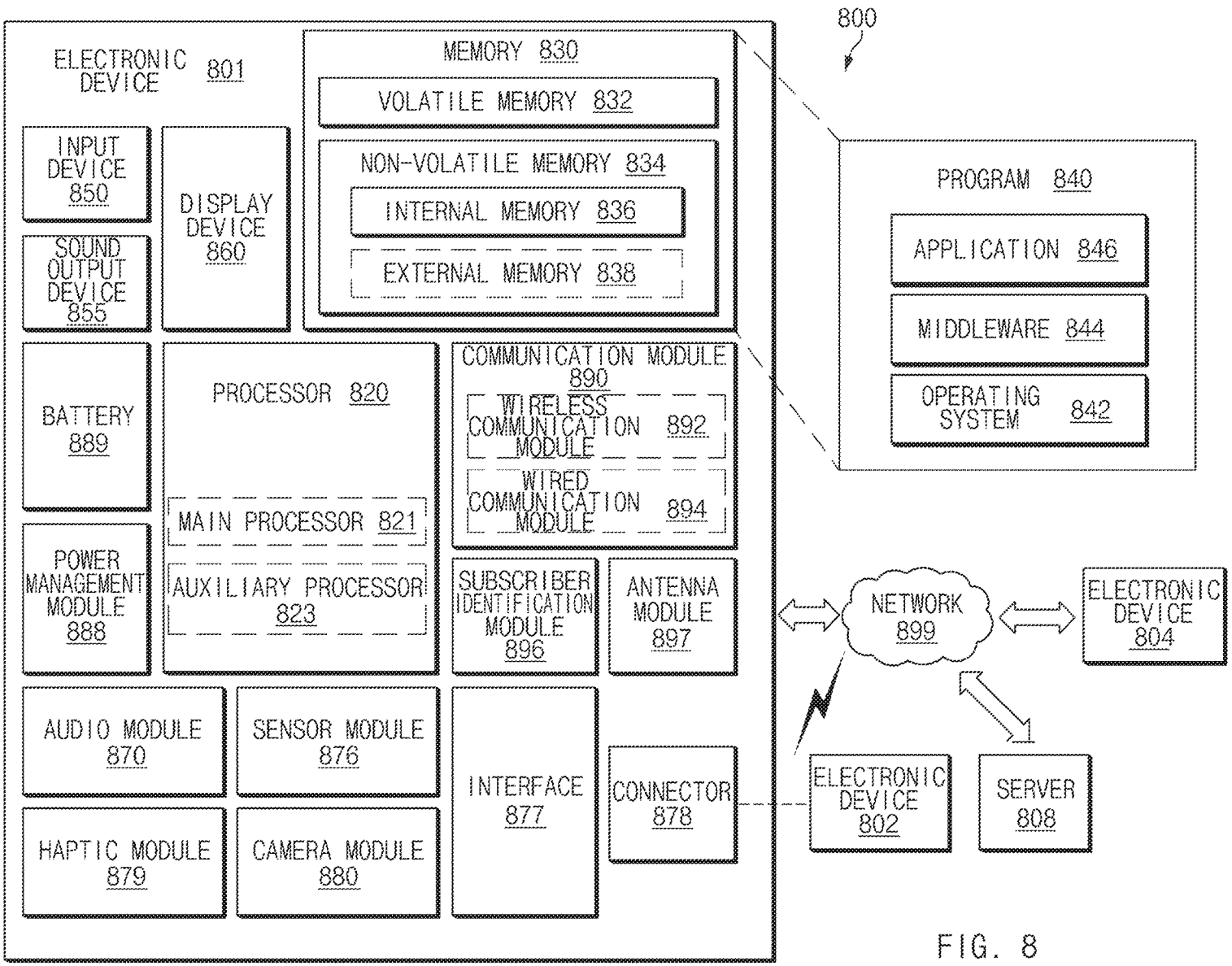
FIG. 8 is a block diagram of an electronic device in a network environment according to an embodiment of the disclosure.

FIG. 8 is a block diagram of an electronic device in a network environment according to an embodiment of the disclosure.

Referring to FIG. 8, an electronic device 801 may communicate with an electronic device 802 through a first network (e.g., a short-range wireless communication) or may communicate with an electronic device 804 or a server 808 through a second network 899 (e.g., a long-distance wireless communication) in a network environment 800. According to an embodiment, the electronic device 801 may communicate with the electronic device 804 through the server 808. According to an embodiment, the electronic device 801 may include a processor 820, a memory 830, an input device 850, a sound output device 855, a display device 860, an audio module 870, a sensor module 876, an interface 877, a haptic module 879, a camera module 880, a power management module 888, a battery 889, a communication module 890, a subscriber identification module 896, and an antenna module 897. According to various embodiments, at least one (e.g., the display device 860 or the camera module 880) among components of the electronic device 801 may be omitted or other components may be added to the electronic device 801. According to various embodiments, some components may be integrated and implemented as in the case of the sensor module 876 (e.g., a fingerprint sensor, an iris sensor, or an illuminance sensor) embedded in the display device 860 (e.g., a display).

The processor 820 may operate, for example, software (e.g., a program 840) to control at least one of other components (e.g., a hardware or software component) of the electronic device 801 connected to the processor 820 and may process and compute a variety of data. The processor 820 may load a command set or data, which is received from other components (e.g., the sensor module 876 or the communication module 890), into a volatile memory 832, may process the loaded command or data, and may store result data into a nonvolatile memory 834. According to an embodiment, the processor 820 may include a main processor 821 (e.g., a central processing unit or an application processor) and an auxiliary processor 823 (e.g., a graphic processing device, an image signal processor, a sensor hub processor, or a communication processor), which operates independently from the main processor 821, additionally or alternatively uses less power than the main processor 821, or is specified to a designated function. In this case, the auxiliary processor 823 may operate separately from the main processor 821 or embedded.

In this case, the auxiliary processor 823 may control, for example, at least some of functions or states associated with at least one component (e.g., the display device 860, the sensor module 876, or the communication module 890) among the components of the electronic device 801 instead of the main processor 821 while the main processor 821 is in an inactive (e.g., sleep) state or together with the main processor 821 while the main processor 821 is in an active (e.g., an application execution) state. According to an embodiment, the auxiliary processor 823 (e.g., the image signal processor or the communication processor) may be implemented as a part of another component (e.g., the camera module 880 or the communication module 890) that is functionally related to the auxiliary processor 823. The memory 830 may store a variety of data used by at least one component (e.g., the processor 820 or the sensor module 876) of the electronic device 801, for example, software (e.g., the program 840) and input data or output data with respect to commands associated with the software. The memory 830 may include the volatile memory 832 or the nonvolatile memory 834.

The program 840 may be stored in the memory 830 as software and may include, for example, an operating system 842, a middleware 844, or an application 846.

The input device 850 may be a device for receiving a command or data, which is used for a component (e.g., the processor 820) of the electronic device 801, from an outside (e.g., a user) of the electronic device 801 and may include, for example, a microphone, a mouse, or a keyboard.

The sound output device 855 may be a device for outputting a sound signal to the outside of the electronic device 801 and may include, for example, a speaker used for general purposes, such as multimedia play or recordings play, and a receiver used only for receiving calls. According to an embodiment, the receiver and the speaker may be either integrally or separately implemented.

The display device 860 may be a device for visually presenting information to the user and may include, for example, a display, a hologram device, or a projector and a control circuit for controlling a corresponding device. According to an embodiment, the display device 860 may include a touch circuitry or a pressure sensor for measuring an intensity of pressure on the touch.

The audio module 870 may convert a sound and an electrical signal in dual directions. According to an embodiment, the audio module 870 may obtain the sound through the input device 850 or may output the sound through an external electronic device (e.g., the electronic device 802 (e.g., a speaker or a headphone)) wired or wirelessly connected to the sound output device 855 or the electronic device 801.

The sensor module 876 may generate an electrical signal or a data value corresponding to an operating state (e.g., power or temperature) inside or an environmental state outside the electronic device 801. The sensor module 876 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 877 may support a designated protocol wired or wirelessly connected to the external electronic device (e.g., the electronic device 802). According to an embodiment, the interface 877 may include, for example, an high-definition multimedia interface (HDMI), a universal serial bus (USB) interface, a secure digital (SD) card interface, or an audio interface.

A connection terminal 878 may include a connector that physically connects the electronic device 801 to the external electronic device (e.g., the electronic device 802), for example, an HDMI connector, a USB connector, an SD card connector, or an audio connector (e.g., a headphone connector).

The haptic module 879 may convert an electrical signal to a mechanical stimulation (e.g., vibration or movement) or an electrical stimulation perceived by the user through tactile or kinesthetic sensations. The haptic module 879 may include, for example, a motor, a piezoelectric element, or an electric stimulator.

The camera module 880 may shoot a still image or a video image. According to an embodiment, the camera module 880 may include, for example, at least one lens, an image sensor, an image signal processor, or a flash.

The power management module 888 may be a module for managing power supplied to the electronic device 801 and may serve as at least a part of a power management integrated circuit (PMIC).

The battery 889 may be a device for supplying power to at least one component of the electronic device 801 and may include, for example, a non-rechargeable (primary) battery, a rechargeable (secondary) battery, or a fuel cell.

The communication module 890 may establish a wired or wireless communication channel between the electronic device 801 and the external electronic device (e.g., the electronic device 802, the electronic device 804, or the server 808) and support communication execution through the established communication channel. The communication module 890 may include at least one communication processor operating independently from the processor 820 (e.g., the application processor) and supporting the wired communication or the wireless communication. According to an embodiment, the communication module 890 may include a wireless communication module 892 (e.g., a cellular communication module, a short-range wireless communication module, or a global navigation satellite system (GNSS) communication module) or a wired communication module 894 (e.g., a LAN communication module or a power line communication module) and may communicate with the external electronic device using a corresponding communication module among them through the first network (e.g., the short-range communication network such as a Bluetooth, a WiFi direct, or an infrared data association (IrDA)) or the second network 899 (e.g., the long-distance wireless communication network such as a cellular network, an internet, or a computer network (e.g., LAN or wide area network (WAN)). The above-mentioned various communication modules 890 may be implemented into one chip or into separate chips, respectively.

According to an embodiment, the wireless communication module 892 may identify and authenticate the electronic device 801 using user information stored in the subscriber identification module 896 in the communication network.

The antenna module 897 may include one or more antennas to transmit or receive the signal or power to or from an external source. According to an embodiment, the communication module 890 (e.g., the wireless communication module 892) may transmit or receive the signal to or from the external electronic device through the antenna suitable for the communication method.

Some components among the components may be connected to each other through a communication method (e.g., a bus, a general purpose input/output (GPIO), a serial peripheral interface (SPI), or an mobile industry processor interface (MIPI)) used between peripheral devices to exchange signals (e.g., a command or data) with each other.

According to an embodiment, the command or data may be transmitted or received between the electronic device 801 and the external electronic device 804 through the server 808 connected to the second network 899. Each of the electronic devices 802 and 804 may be the same or different types as or from the electronic device 801. According to an embodiment, all or some of the operations performed by the electronic device 801 may be performed by another electronic device or a plurality of external electronic devices. When the electronic device 801 performs some functions or services automatically or by request, the electronic device 801 may request the external electronic device to perform at least some of the functions related to the functions or services, in addition to or instead of performing the functions or services by itself. The external electronic device receiving the request may carry out the requested function or the additional function and transmit the result to the electronic device 801. The electronic device 801 may provide the requested functions or services based on the received result as is or after additionally processing the received result. To this end, for example, a cloud computing, distributed computing, or client-server computing technology may be used.

The PCBs 120, 600, and 700 according to various embodiments of the disclosure may be included in the electronic device 801. In this case, the communication module 890 may feed the PCBs 120, 600, and 700 to transmit and receive a signal of a specified frequency band (e.g., 28 GHz).

The electronic device according to various embodiments disclosed in the disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the disclosure should not be limited to the above-mentioned devices.

It should be understood that various embodiments of the disclosure and terms used in the various embodiments do not intend to limit technologies disclosed in the disclosure to the particular forms disclosed herein; rather, the disclosure should be construed to cover various modifications, equivalents, and/or alternatives of embodiments of the disclosure. With regard to description of drawings, similar components may be assigned with similar reference numerals. As used herein, singular forms may include plural forms as well unless the context clearly indicates otherwise. In the disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the disclosure may be implemented by software (e.g., the program 840) including an instruction stored in a non-transitory machine-readable storage media (e.g., an internal memory 836 or an external memory 838) readable by a machine (e.g., a computer). The machine may be a device that calls the instruction from the machine-readable storage media and operates depending on the called instruction and may include the electronic device (e.g., the electronic device 801). When the instruction is executed by the processor (e.g., the processor 820), the processor may perform a function corresponding to the instruction directly or using other components under the control of the processor. The instruction may include a code generated or executed by a compiler or an interpreter. The machine-readable storage media may be provided in the form of non-transitory storage media. Here, the term "non-transitory", as used herein, is a limitation of the medium itself (i.e., tangible, not a signal) as opposed to a limitation on data storage persistency.

According to an embodiment, the method according to various embodiments disclosed in the disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the disclosure may be executed sequentially, in parallel, repeatedly, or in a heuristic method. Also, at least some operations may be executed in different sequences, omitted, or other operations may be added.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:
a housing comprising:
a first surface,
a second surface facing the first surface, and
a side surface surrounding a space between the first and second surfaces;
a printed circuit board (PCB) disposed inside the housing and including at least one antenna; and
a communication circuit disposed inside the PCB or between the PCB and the housing,
wherein the PCB comprises:
a first substrate,
a second substrate facing the first substrate, and
a spacer disposed between the first and second substrates, the spacer including an opening extending from the first substrate to the second substrate, a side surface of the spacer being plated or surrounded by a conductive material,
wherein each of the at least one antenna comprises:
a first conductive member formed on the first substrate,
a second conductive member formed on the second substrate and facing the first conductive member through the opening, and
a feeder connecting the second conductive member to the communication circuit, and
wherein the communication circuit is configured to:
feed the feeder, and
transmit and receive a signal of a specified frequency band through an electrical path formed through the feeder and through the second conductive member.

2. The electronic device of claim 1, further comprising a dielectric material disposed in a space between the second conductive member and the first conductive member.

3. The electronic device of claim 1, wherein each of the at least one antenna further comprises a plurality of vias surrounding the opening.

4. The electronic device of claim 3,
wherein the at least one antenna comprises a first antenna and a second antenna, and
wherein the plurality of vias block interference between the first antenna and the second antenna.

5. The electronic device of claim 4, wherein the first antenna and the second antenna are configured to transmit or receive signals of mutually different frequency bands.

6. The electronic device of claim 1, wherein the first conductive member and the second conductive member are formed of a type of conductive material.

7. The electronic device of claim 1,
wherein the first conductive member is spaced a specified distance from the spacer, and
wherein the spacer is spaced the specified distance from the second conductive member.

8. The electronic device of claim 1,
wherein the first substrate and the spacer adhere to each other by an adhesive material, and
wherein the spacer and the second substrate adhere to each other by the adhesive material.

9. The electronic device of claim 1,
wherein the spacer comprises a plurality of non-conductive layers, and wherein conductive layers are disposed between the plurality of non-conductive layers, respectively.

10. The electronic device of claim 1, wherein the PCB is disposed between the second conductive member and the spacer, and wherein the PCB further comprises a non-conductive material surrounding the second conductive member.

11. An electronic device comprising:

a housing comprising:

a first surface, a second surface facing the first surface, and a side surface surrounding a space between the first and second surfaces; and a printed circuit board (PCB) disposed inside the housing or attached to the first surface, wherein the PCB comprises:

at least one antenna, and a wireless communication circuit electrically connected to each of the at least one antenna, wherein each of the at least one antenna comprises:

a first conductive member disposed in a first region, a second conductive member disposed in a second region facing the first region, and a feeder electrically connecting the second conductive member to the wireless communication circuit, wherein the wireless communication circuit is configured to:

feed the feeder, and transmit and receive a signal of a specified frequency band through an electrical path formed through the feeder and through the second conductive member, and wherein the PCB further comprises a spacer disposed between the first conductive member and the second conductive member, the spacer including an opening extending from the first conductive member to the second conductive member, a side surface of the spacer being plated or surrounded by a conductive material.

12. The electronic device of claim 11, wherein the spacer configured to space the first and second regions apart from each other, and wherein the first conductive member and the second conductive member face each other through the opening of the spacer.

13. The electronic device of claim 12, wherein each of the at least one antenna further comprises a plurality of vias surrounding the opening.

14. The electronic device of claim 12, wherein the PCB further comprises a first substrate and a second substrate facing the first substrate, wherein the spacer is disposed between the first and second substrates, wherein the first region includes at least a part of the first substrate, and wherein the second region includes at least a part of the second substrate.

15. The electronic device of claim 1, wherein the communication circuit is further configured to, in response to a current being fed, transmit and receive the signal of the specified frequency band based on the electrical path formed through the feeder and through the second conductive member.

* * * * *